US005405823A

United States Patent [19]

Fujimura et al.

[11] Patent Number: 5,405,823

[45] Date of Patent: Apr. 11, 1995

[54] THERMOSENSITIVE RECORDING MATERIAL

[75] Inventors: Hideo Fujimura; Haruo Takeuchi; Katsuyuki Oshima, all of Tokyo, Japan

[73] Assignee: Dai Nippon Insatsu Kabushiki Kaisha, Japan

[21] Appl. No.: 177,384

[22] Filed: Jan. 5, 1994

Related U.S. Application Data

[63] Continuation of Ser. No. 950,699, Sep. 25, 1992, Pat. No. 5,296,446, which is a continuation of Ser. No. 832,313, Feb. 7, 1992, abandoned, which is a continuation of Ser. No. 474,036, Apr. 13, 1990, abandoned.

[30] Foreign Application Priority Data

| | | | |
|---|---|---|---|
| Aug. 13, 1988 | [JP] | Japan | 63-202125 |
| Aug. 17, 1988 | [JP] | Japan | 63-204132 |
| Sep. 12, 1988 | [JP] | Japan | 63-226427 |
| Sep. 20, 1988 | [JP] | Japan | 63-246143 |

[51] Int. Cl.[6] ..... B41M 5/035; B41M 5/38

[52] U.S. Cl. ..... 503/227; 428/195; 428/423.1; 428/447; 428/480; 428/482; 428/913; 428/914

[58] Field of Search ..... 8/471; 428/195, 423.1, 428/480, 447, 913, 914, 482; 503/227

[56] References Cited

U.S. PATENT DOCUMENTS 4,877,922 10/1989 Sasaki et al. ..... 528/272

*Primary Examiner*—B. Hamilton Hess
*Attorney, Agent, or Firm*—Parkhurst, Wendel & Rossi

[57] ABSTRACT

The present invention relates to a thermosensitive recording material used in combination with a heat transfer sheet carried thereon with a thermally transferable dye, which is characterized in that it comprises a substrate 1 and a dye-receiving layer 2 provided on at least one surface of the substrate 1, the dye-receiving layer 2 being obtained by crosslinking and curing a resin having a crosslinkable reaction group with an additive having a crosslinkable reaction group.

3 Claims, 2 Drawing Sheets

THERMOSENSITIVE RECORDING MATERIAL

This is a continuation of application Ser. No. 07/950,699, filed Sep. 25, 1992, now U.S. Pat. No. 5,296,446, which in turn is a continuation of Ser. No. 07/832,313, filed Feb. 7, 1992, now abandoned, which in turn is a continuation of Ser. No. 07/474,036, filed Apr. 13, 1990, now abandoned.

TECHNICAL FIELD

The present invention relates to a recording medium used with a thermosensitive transfer recording system for printing or imaging by thermal printing means such as a thermal head and, more particularly, to a thermosensitive recording medium used in combination with a heat transfer sheet having a dye carrying layer.

BACKGROUND ART

A currently existing thermosensitive recording medium or material is used in combination with a heat transfer sheet having a heat transfer layer containing thermally transferable dyes. That material is superposed upon the heat transfer sheet while said heat transfer layer is in contact with an image receiving or imageable layer. Then, heat is applied by such thermal printing means such as a thermal head which is controlled by an electrical signal corresponding to image information from the back side of the heat transfer sheet with a thermosensitive printer, etc. to generate heat, thereby transferring the dyes in the heat transfer sheet into the image receiving layer to form a gradient image like a natural color photograph. Typical of this is a thermosensitive image-receiving sheet.

Such a thermosensitive recording material has a disadvantage of making it difficult to provide a satisfactory releasing of the heat transfer sheet from the recording material, because the heat transfer layer (a dye layer) is thermally fused to the image-receiving layer (a dye-receiving layer) by heating at the time of printing with a thermal printer. To eliminate this disadvantage, it has heretofore been proposed to incorporate a release agent in a resin for forming the dye-receiving layer by mixing.

With the dye-receiving layer in which the release agent is only mixed with that resin, however, the heat resistance of the dye-receiving layer per se is less than satisfactory with no achievement of sufficient releasability, partly because the release agent remains only mixed with said resin.

DISCLOSURE OF THE INVENTION

In order to overcome these problems, the present invention has for its object the provision of a thermosensitive recording material having a dye-receiving layer excelling in both releasability and heat resistance.

BEST MODE FOR CARRYING OUT THE INVENTION

Figure 1:
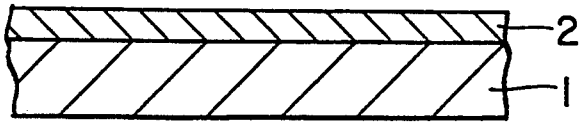
FIGS. 1 to 8 are sectional views showing embodiments of the thermosensitive recording material according to the present invention.

As illustrated in the sectional view of FIG. 1, a thermosensitive material of the present invention comprises a substrate 1 and a dye-receiving layer 2 formed thereon.

The above object is achieved by the provision of a thermosensitive recording material used in combination with a heat transfer sheet carried thereon with a thermally transferable dye, characterized in that it comprises a substrate and a dye-receiving layer formed on at least one surface of said substrate, said dye receiving layer being obtained by crosslinking and curing a resin having a crosslinkable reaction group with an additive having a crosslinkable reaction group. The present invention is also characterized in that the crosslinkable reaction group-containing additive is added in excess to the resin containing a crosslinkable reaction group.

In the present invention, a release agent containing a crosslinkable reaction group may be incorporated as a part of the material forming the dye-receiving layer in addition to the above additive.

Substrate

The substrate 1 used as a support in the present invention serves to carry the dye-receiving layer 2, and may be formed of any suitable material depending upon the purposes. For instance, use may be made of films, sheets, sheetings, etc. formed of synthetic resins and various types of paper. Synthetic resin films (or sheets or sheetings) may be formed of polyester, polyvinyl chloride, polypropylene, polyethylene, polycarbonate, polyamide and the like. Use may also be made of white substrates obtained by forming such synthetic resin films, etc. with fillers into films or foamed substrates obtained by microfoaming. As the paper materials, use may be made of slick paper, coated paper, cast coated paper, synthetic rubber latex or synthetic resin emulsion-impregnated paper and so on. Use may also be made of paper obtained by mixing inorganic fillers with a resinous component such as polyolefinic resin or other synthetic resin and extruding the mixture, synthetic paper obtained by coating a pigment on the surface of a film formed of a resin such as polystyrene, polyester and polyolefin.

Further, laminates comprising any combination of the above substrates may be used. Typical of such laminates are combinations of cellulosic fiber paper with synthetic paper or cellulose fiber paper with a plastic film or sheet. Such substrates may have any suitable thickness, generally of about 10 to 800 $\mu$m.

When the substrate is poor in the adhesion to the dye-receiving layer, it is desired that its surface be primer- or corona-treated. The substrate may be dispensed with depending upon the structure of the dye-receiving layer.

Dye-Receiving Layer

The dye-receiving layer serves to form thereon a heat transfer image and basically comprises a resin capable of receiving a dye transferred from a heat transfer sheet at the time of heat transfer and containing a crosslinkable reaction group and an additive containing a crosslinkable reaction group. In addition to the above resin and additive, an additional release agent again containing a crosslinkable reaction group may be added to the dye-receiving layer. The crosslinkable reaction groups in the present invention refer to (1) a thermosetting reactive group (for instance, $$-OH, \quad -NH_2, \quad -COOH, \quad -CONH_2,$$

-continued

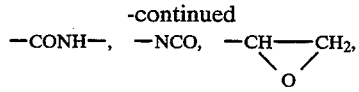

ultraviolet- or electron beam-curing reactive group (for instance, vinyl, acrylic, methacrylic, allyl and other groups).

The above resins containing crosslinkable reaction groups may include polyester resin, acrylic resin, vinyl resin, polyurethane resin, cellulosic resin, polysaccharide or other resins, which are modified by introducing into their molecular chains one or more such crosslinkable reaction groups as mentioned above (which may be identical with or different from each other). These resins may be used alone or in combination of two or more. The above release agents may include silicone, fluorine, long-chain aliphatic hydrocarbon compounds, waxes and other like substances, which are modified by introducing into their molecular chains one or more such crosslinkable reaction groups as mentioned above (which may be identical with or different from each other). The above additives may include heat-curing compounds such as polyisocyanates (containing at least two -NCO groups), polyols (containing at least two -OH groups), polyamines (containing at least two —$NH_2$ groups) and polycarboxylic acids (containing at least two —COOH groups) and ultraviolet- or electron radiation-curing monomers such as those containing in their molecular chains one or more such crosslinkable reaction groups as mentioned above (which may be identical with or different from each other).

In the dye-receiving layer of the present invention, the resin capable of receiving a resin and the additive or the resin capable of receiving a resin, the additive and the release agent are crosslinked and cured alone or in combination through the crosslinkable reaction groups into a three-dimensional crosslinked structure. By the incorporation of the above additive in particular, it is possible to suitably regulate various functions of the dye-receiving layer after crosslinking and curing such as spreadability, heat resistance, flexibility and surface activity.

In some cases, conventional thermosensitive recording materials present a phenomenon that when the dye is transferred into the dye-receiving layer by heating, the concentration of reflection cannot exceed a certain level or, to put it another way, is saturated or reach the top, because the printed surface is embossed into a matte by the amount of heating exceeding a certain fixed value.

Known to avoid this is a simple method of heat-treating the recording materials by means of heated rolls, etc. after the completion of printing.

In order to carry out heat treatment after the completion of printing, however, it is required to provide separate heat-treating equipment in addition to a printing machine. Incorporation of such heat treating machinery into the printer gives rise to an increase in the energy consumption and cost of the printer per se.

The present inventors have now found that the above problem, that is, degradation of the print face by the embossing of the print face, is successfully solved by using an isocyanate compound containing at least two isocyanate groups as the above additive and using the additive in an excessive amount with respect to the resin.

More specifically, it is preferred to eliminate the above problem that the ratio of the equivalent of the isocyanate groups of the above additive to that of the crosslinkable reaction group of the aforesaid resin be in a range of 2:1 to 10:1. If the equivalent ratio is below 2:1, then there arises a problem that when printing is carried out with high energy, the print face is embossed into a matte and so becomes foggy. On the other hand, an equivalent ratio exceeding 10:1 is unpreferred, since there is then a drop of printing sensibility with a drop of the storability of the print.

Preferably, the amount of the release agent added is in a range of about 0.1 to 20 parts by weight relative to 100 parts by weight of the resin capable of receiving a dye. When that amount departs from such a range, some problems arise. For instance, when the amount of the release agent is too small, it is so thermally fused to the heat transfer sheet that the storability of the printed image deteriorates. When the amount of the release agent is too large, on the other hand, the printed image is so poor in storability that it can be mottled.

According to the present invention, a catalyst may be added to the resin forming the receiving layer to accelerate its crosslinking or curing.

As well-known, it is generally carried out to add catalysts to isocyanates so as to increase their rate of reaction. Catalysts heretofore used industrially to this end include tertiary amines and organic metal compounds.

In some cases, however, such catalysts as mentioned above are not necessarily preferred for use with the receiving layers of such thermosensitive recording materials as contemplated in the present invention. Especially when tertiary amine compounds are used as catalysts, the storage properties (esp., heat resistance and weather resistance) of the printed image are poorer than when they are not used.

According to the present invention, such problems as mentioned above can be eliminated by using organometallic compounds as catalysts, esp., those based on dibutyltin or dioctyltin.

Preferably, the catalysts based on dibutyltin may include, for instance, dibutyltin dilaurate, dibutyltin oxide, dibutyltin dichloride, dibutyltin di-2-ethylhexyl thioglycolate, dibutyltin di(monobutyl) maleate, dibutyltin di(monononyl) maleate, dibutyltin diacetate, dibutyltin mercaptide, dibutyltin β-mercaptopropionate, dibutyltin thiocarboxylate and dibutyltin di-2-ethylhexoate.

On the other hand, the catalysts based on dioctyltin may preferably include dioctyltin dilaurate, dioctyltin thioglycolate, dioctyltin β-mercaptopropionate, dioctyltin-1,4-butanediol-bis(mercaptoacetate), dioctyltin ethylene glycol dithioglycolate, dioctyltin thiocarboxylate, dioctyltin maleate, dioctyltin maleate polymer, dioctyltin-(1,2-propylene glycol maleate), dioctyltin-di-(monobutyl) maleate, dioctyltin-bis-(2-ethylhexyl maleate), dioctyltin-bis-(lauryl thioglycolate), dioctyltin oxide, dioctyltin dichloride, mono-octyltin dichloride and trioctyltin dichloride.

Other organometallic compounds, which may be used in the present invention, include stannous octoate, lead octoate, cobalt naphthenate, stannous chloride, stannic chloride, tetra-n-butyltin, tetraphenyltin, trimethyltin hydroxide and dimethyl-2-tin chloride.

Particular preference is given to the compounds based on dioctyltin in view of their toxicity.

The amount of the catalyst added is in a range of 0.01 to 10 parts by weight, preferably 0.1 to 1 part by weight relative to 100 parts by weight of the resin containing functional groups reacting with the isocyanate groups. At less than 0.01 part by weight, the catalyst does not produce any effect upon accelerating the reaction or reducing the length of reaction time. At higher than 10 parts by weight, on the other hand, the catalyst may be effective to promote the reaction, but reduces the pot life of ink. The above catalysts may be used alone or in combination.

The dye-receiving layer may be formed by providing an ink composition for forming the receiving layer by preparing the resin capable of receiving a dye and the additive (and the release agent) with a solvent, etc. and coating that ink composition on a support or substrate by suitable means such as gravure printing, screen printing and reverse roll coating with a gravure press, followed by drying. When the crosslinkable reaction groups applied are of the ultraviolet- or electron radiation-curable type, crosslinking and curing reactions may take place by exposure to ultraviolet rays or electron radiations. The dye-receiving layer may have a thickness of about 1 to 20 μm, preferably about 2 to 10 μm.

By suitable selection of supports, the thermosensitive recording materials of the present invention may have various applications in the form of heat transfer recordable image-receiving sheets, cards, transmission types of sheets for preparing MSS and the like.

Additional Layers

It is understood that the thermosensitive recording materials of the present invention may be provided with additional layers, or otherwise be subjected to various treatments, as required.

That is, the present recording material may be subjected on its one major side with antistatic treatment, which may be carried out by incorporating an antistat in, e.g., the dye-receiving layer providing the front major side or providing it on the surface of the dye-receiving layer in the form of an antistatic layer. Similar treatment may also be applied to other major or minor sides. This treatment provides a smooth feeding of the recording materials and is effective to prevent dust, etc. from being deposited onto the recording materials.

Between the substrate and the receiving layer, there may also be provided a cushioning layer, with which it is possible to reproduce with high reproducibility an image of limited noise and corresponding to image information. The cushioning layer may be made up of suitable resins such as urethane resin, acrylic resin, ethylenic resin, butadiene rubber and epoxy resin. Preferably, the cushioning layer may have a thickness of about 2 to 20 μm.

Further, a lubricating layer may be provided on the back side of the substrate. The lubricating layer may be made up of suitable resins such as methacrylate resin, e.g., methyl methacrylate or the corresponding acrylate resin and vinylic resin, e.g., vinyl chloride/vinyl acetate copolymers. To regulate lubricity, organic or inorganic microparticles may be added to the lubricating layer.

Furthermore, the recording material may be provided with a detection mark, with which the positioning of the heat transfer sheet relative to the recording material, etc. can be carried out very conveniently. For instance, a detection mark capable of being sensed by a phototube sensor may be provided on the back side, etc. of the substrate.

Application to Cards

In recent years, cards such as cash cards and credit cards have been used as information recording media in card forms. In such cards, the required information is imparted to the surfaces of card substrates formed of, e.g., synthetic resins. Heretofore, the information has been imparted by various means such as printing and magnetic recording, but characters, patterns, etc. have been applied by printing.

However, cards to which characters, patterns, etc. are applied by printing are troublesome to produce. In particular, grave difficulties are now encountered in making cards to which multi-colored characters, patterns, etc. are applied.

In conventional prepaid cards such ticket and telephone cards, the substrates such as polyester sheets are provided on their surfaces with magnetic recording layers having thereon colored or otherwise silvered layers for ornamental purposes or with a view to protecting the magnetic recording layers and on their opposite sides with prints for the purpose of ornamentation, publicity, advertisement and other purposes.

Some telephone cards may be mass-produced. In recent years, however, there has been much demand for telephone cards custom-made at the bidding of individuals or firms for varied purposes such as commemoration, presentation, propaganda and advertisement. Such cards are often printed in small lots, say, on the order of tens or hundreds.

Such printing as mentioned above has been performed by offset, gravure, silk screen and other processes. Thus, no appreciable problem arises in connection with printing in large lots. However, plate-making, printing and other costs are given much weight in printing in small lots on the order of tens or hundred, posing a great cost problem.

The aforesaid heat transfer systems have the advantages of making it possible to make blank cards (to be printed on their surfaces) and to make a printing on a few, or as small as dozens of, blank cards at low printing costs and for an individual's hobby. Especially because of being made up of plastics, the card substrates are locally heated at the time of heat transfer, resulting in the formation of fine irregularities on their surfaces. This is true particularly when the thermal head of a printer is heated to a temperature sufficiently high to increase the density of printing.

The occurrence of such micro-irregularities renders it impossible to use equipment such as telephones or ticket dispensers, since no smooth feeding of the cards is then achieved. Even if the cards can be fed, their convex portions are so worn away that they become unattractive, or there is a drop of the accuracy of reading-out or writing-in of the information recorded in the magnetic recording materials, causing trouble.

Another problem is that the cards curl after printing. Thus, the prior art has yet to make the best use of the advantages of the heat transfer systems.

According to the present invention, the thermosensitive recording material is formed into a card, the substrate of which is then provided on the whole or a part of at least one major side with a magnetic recording layer to obtain a magnetic card which also serves as a thermosensitive recording material. Such a magnetic card presents no or little problem of irregularities or curling, which are otherwise caused by heat at the time of printing, since the dye-receiving layer comprises a material obtained by the curing of such a specific crosslinkable resin as mentioned above.

According to such a mode for the practice of the present invention as mentioned above, there is further provided a magnetic card having much improved heat resistance and free from any problem of irregularities or curling, which is otherwise caused by heating with a thermal head at the time of heat transfer, by separate provision of a backing layer consisting of a crosslinkable resin on the upper surface of the magnetic recording layer of the magnetic card.

Figure 2:
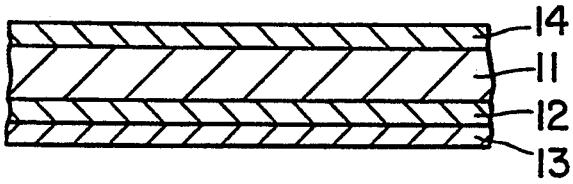
Figure 3:
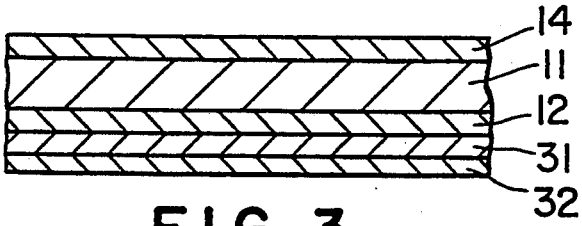

FIGS. 2 and 3 are schematic views showing the sections of illustrative examples of magnetic cards to which the present invention is applied.

As illustrated, one magnetic card of the present invention comprising a substrate 1 including thereon a magnetic recording layer 12 and a magnetism-protecting layer 13 and on the opposite side a layer 14 for receiving a sublimable dye is characterized in that said backing layer 13 is formed by using a crosslinkable resin as a binder.

In the illustrative example shown in FIG. 2, the backing layer 13 consists only of a colored concealing layer in which metal powders, pigments or dyes are used as a colorant and a crosslinkable resin is employed as a binder. In the illustrative example shown in FIG. 3, the backing layer 13 comprises a colorant-containing colored concealing layer 31 and a transparent back protecting layer 32. In the second example, the colored layer 31 and/or the back protecting layer 32 may be formed of a crosslinkable resin.

The above magnetic card of the present invention is substantially identical with a conventional magnetic card, except that the colored concealing layer and/or the back protecting layer are formed of a crosslinkable resin.

The term "crosslinkable resin" refers to a resin, the molecules of which, after the formation of a layer, form a crosslinked network structure directly or through a crosslinker or polymerization initiator, and which is well-known in itself in the art of paints or printing.

The resins forming a crosslinked structure may include, for instance, those containing in their molecules hydroxyl, amino, carboxyl, carboamide, acid amide, isocyanate, glycidyl, methylol, vinyl, acrylic, methacrylic, allyl or other groups or oligomers. More illustratively but not exclusively, use may be made of amino, urea, phenol, melamine, alkyd, cellulose, acrylic, vinyl, polyester, polyamide, polyurethane, acrylic polyol, acrylic urethane and unsaturated polyester resins as well as their modified resins, all containing such groups as mentioned above.

In terms of curing processes, such resins are broken down into heat curing resins crosslinked by heating, two-part resins crosslinked by crosslinkers such as polyisocyanates, polyols, polyamines and polycarboxylic acids, cold curing resins crosslinked by catalysts and photo-curing resins crosslinked by ultraviolet rays or electron radiations.

When forming the colored layer with the above crosslinkable resin, it is mixed with a colorant such as metallic flake pigments, color pigments, white pigments and dyes and, if required, with a diluent such as organic solvents to impart printability or coatability thereto. Then, the mixture is coated on the surface of the aforesaid magnetic recording layer in conventional manners such as gravure printing, screen printing, gravure offset printing or gravure coating, followed by drying and curing. Such a colored layer may have a thickness of about 1 μm to 20 μm. The density of crosslinking of the layer to be formed can be freely varied by the type of binders used, the quantity of crosslinkers used or the dose of light applied. However, the object of the present invention is unachievable at a low degree of crosslinking, whereas too high a degree of crosslinking is unpreferred, since the coat is so lacking in flexibility that it can foliate or crack. Thus, the density of crosslinking is suitably such that the substrate is not deformed by the heat of a thermal head at the time when making a printing on the dye-receiving layer formed of the back side thereof. It is easy to determine such a degree of crosslinking experimentally. For instance, the molecular weight per one point of crosslinking is preferably in a range of about 1,000 to about 50,000 in the present invention.

Crosslinking may be achieved by any one of heat-, cold- and photo-curing. When a relative high degree of crosslinking is required, however, preference is given to photo-curing.

The backing layer may consist only of the colored concealing layer, as illustrated in FIG. 2, or may be of a double layer structure comprising the colored concealing layer and the back protecting layer, as illustrated in FIG. 3. It is understood that when the backing layer comprises two parts, one or both thereof may be formed of the crosslinkable resin.

The back protecting layer may be formed in similar manners as the colored concealing layer, except that it is made transparent with no use of any colorant.

In general, recording materials in card forms are prone to generating static electricity. For instance, when cards are inputted into transfer equipment by an autofeeder, there is a problem that they are inputted while overlapping each other. Another problem with static electricity is that dust remains deposited or the magnetic information recorded in the magnetic recording layer is destroyed.

According to the present invention, therefore, an antistatic layer may be provided on the surface of the dye-receiving layer for the purpose of preventing the generation of static electricity.

Figure 4:
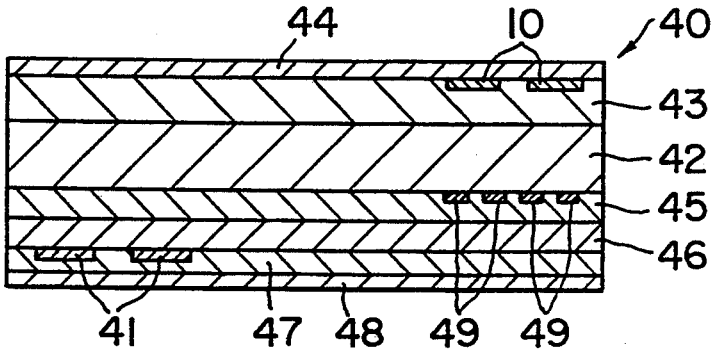

Referring to a card 44 in FIG. 4 as an example, a dye-receiving layer 43 is provided on one side of a card substrate 42, and an antistatic layer 44 is attached to the surface of the dye-receiving layer 43.

Known antistatic treatment techniques may be applied to the antistatic layer 44. For instance, the antistatic layer may be formed by the application of an anionic surface active agent such as alkyl sulfates or phosphates, a nonionic surfactant such as polyoxyalkylene alkyl ether, polyoxyalkylene alkylphenyl ether, polyoxyalkylene fatty acids ester, polyoxyalkylene sorbitan fatty acid ester and sorbitan fatty acid ester, a cationic surfactant such as alkylamine salts and quaternary ammonium salts and an amphoteric surfactant such as alkyl betaine; however, this has a disadvantage of being poor in durability. Siloxane compounds or polymers with a quaternary ammonium salt in their side chains may also be used as antistats. In addition, inks, containing carbon black and metal powders may be applied; however, this has a disadvantage of reducing the transmissibility of an image transfer-recorded on the dye-receiving layer 43. Thus, it is preferable to form an antistatic resin coat by the application of inks containing the above surfactants or resins having antistatic functional groups. Preferably, the antistatic layer 44 should have a thickness of 0.001 to 1 μm, particularly 0.01 to 0.1 μm. Reliance may also be placed upon a technique for forming a metallized layer having a thickness sufficient to make it transparent by metallization, say, 100 to 500 angstroms. Preferably, the antistatic layer 44 has a surface resistivity of $10^8$ to $10^9$ ohms/cm$^2$.

The above substrate for cards, generally shown at 40, includes a substrate material 42 having a magnetic recording layer 45 on its back side. Said magnetic recording layer 45 is provided on its back side with a silvered concealing layer 46 for concealing the color of the magnetic recording layer 45. On the back side of the layer 46, there are further provided a backing protective layer 47 and an antistatic layer 48 in that order. The silvered concealing layer 46 may be formed of an ink in which metal powders such as aluminium powders are dispersed in a binder such as polyurethane, polyester or acrylic resin. The back protecting layer 47 may be formed of a vinylic resin such as acrylic resin, polyurethane and vinyl chloride/vinyl acetate copolymers. The antistatic layer 48 on the back side may be formed in similar manners as applied for forming the antistatic layer 44 on the front side. Although the antistatic layer 48 on the back side may be dispensed with, yet it is preferred, since a further improved antistatic effect is obtained by the provision of the antistatic layer 48 on the back side.

It is to be noted that reference numeral 49 stands for bar codes and 10 and 41 denote pre-provided printable layers. The printable layer 10 located on the side of the dye-receiving layer 43 may be provided on the upper side of the layer 43, as illustrated, or alternatively on the lower side thereof.

Figure 5:
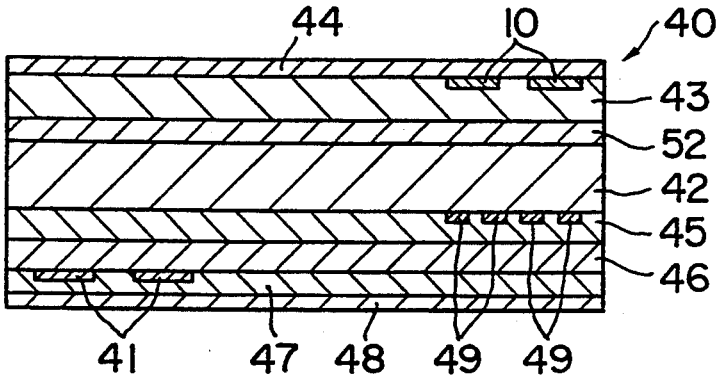

According to the present card 40, intermediate layers 52 such as cushioning and porous layers may be arranged between the dye-receiving layer 43 and the card substrate material 42, as illustrated in FIG. 5. By the provision of such intermediate layers 52, an image of reduced noise and corresponding to an image information input can be heat-transferred and recorded with improved reproducibility. The intermediate layers 52 may be formed of, e.g., urethane resin, acrylic resin, ethylenic resin, butadiene rubber, epoxy resin or the like and have preferably a thickness of about 2 to 20 μm.

Figure 6:
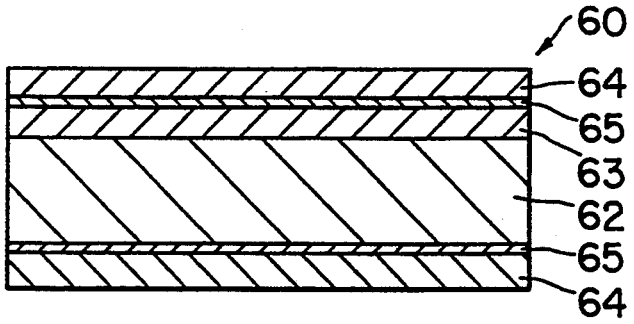

Referring to a card 60 shown in FIG. 6, the dye-receiving layer 63 and card substrate material 62 are each provided on the surface with a covering film 64. It is to be noted that reference numeral 65 in FIG. 6 stands for an adhesive layer. The covering film 64 provides a protection against the dye-receiving layer. The covering films 64 may be formed of acrylics, polyvinyl chloride, polyester, vinyl chloride/vinyl acetate copolymers, vinylic resin and so on.

Figure 7:
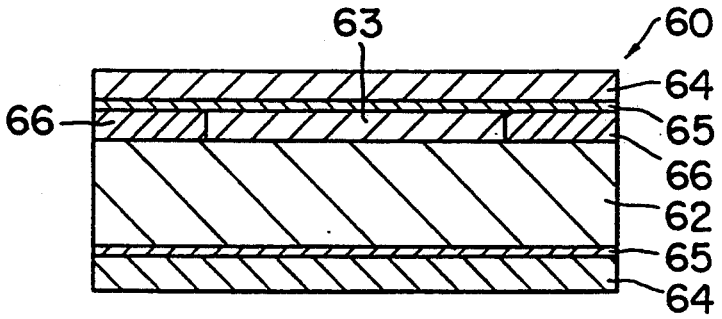

Referring to a card 60 shown in FIG. 7, a dye-receiving layer 63 is formed on a part of the surface of a card substrate material 62. On another part, there is provided a spacer 66. By providing the spacer 66 to locate the dye-receiving layer on a part of the card substrate, it is possible to eliminate irregularities on the covering films. The spacer 66 may be formed of similar synthetic resins to those forming the above covering films.

Figure 8:
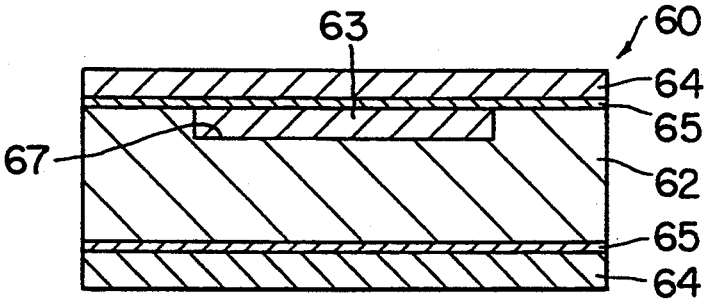

Referring to a card 60 shown in FIG. 8, a recess or dent 67 is provided in a part of the surface of a card substrate material 62 to receive therein a dye-receiving layer 63. As is the case with FIG. 7, it is possible to eliminate irregularities on covering films 64.

The present invention will be described in more detail with reference to the following examples.

EXAMPLES 1-17 AND COMPARATIVE EXAMPLES 1-10

Ink compositions for the formation of dye-receiving layers were prepared with such crosslinkable reaction group-containing reactive resins and release agents and additives as indicated in Tables 1 and 2. Each ink composition was coated on a white polyethylene terephthalate film of 100 μm in thickness (Lumilar E-20, made by Toray Industries, Inc.) by gravure reverse roll coating to obtain a given coat thickness on dry basis. It is to be noted that the ink composition of Example 14 contains 0.5 parts by weight of benzophenone.

For thermal crosslinking and curing, heating was then carried out in an oven of 120° C. for 10 minutes to prepare image-receiving or imageable sheets including crosslinked and cured dye-receiving layers.

For ultraviolet- or electron radiation-curing (UV/EB curing types), on the other hand, curing was performed in the following manners. For ultraviolet curing, curing was carried out with ultraviolet rays emitting from three high-pressure mercury lamps (80 W/cm), and for electron radiation curing, curing was effected with electron beams emitting from an EB irradiator (made by ESI; Electocurtain Type 175 KV, 3 Mrad.). Thus, imageable sheets including crosslinked and cured dye-receiving layers were obtained.

Various properties of the thus obtained imageable sheets were found in the following manners. The results are set forth in Table 2-1 and 2.

(1) Preparation of Transfer Sheets Used For Transfer Recording

A dye transfer layer forming ink composition, composed of such ingredients as mentioned below, was printed on the surface side of a polyester film of 4.5 μm in thickness and having on its back side a heat-resistant lubricating layer by gravure printing to form a dye transfer layer in a coated amount of 1.1 g/m$^2$ on dry basis, thereby preparing a transfer sheet.

Dye Transfer Layer-Forming Ink

| | |
|---|---|
| Cyanogen Dye (made by Nippon Kayaku Co., Ltd. Japan; Dispersion Dye C.I. Solvent Blue 63) | 4 parts by weight |
| Polyvinyl Butyral Resin (made by Sekisui Chemical Co., Ltd., Japan; Slec BX-1) | 4.3 parts by weight |
| Solvent (toluene/methyl ethyl ketone/isobutanol = 4/4/2) | 90 parts by weight |

(2) Transfer Recording

Using the above transfer sheet with the transfer layer overlying the dye-receiving layer of each imageable sheet, printing was carried out with a thermosensitive head under the following conditions.

Printing Conditions Line Density for Main- and Sub-scanning: 6 dots/mm. Recording Power: 0.32 W/dot. Heating Time of Head: 10 msec.

(3) Measurement of the density of developed color

Measured by a Macbeth densitometer.

(4) Measurement of the rate of thermal fading

The density of color development was measured before and after the printed image was allowed to stand at 70° C. for 24 hours. The rate of thermal fading was found by the following equation.

$$\text{Rate of thermal fading (\%)} = \frac{\text{(density-before)} - \text{(density-after)}}{\text{(density-before)}} \times 100$$

(5) Determination of coefficient of friction

The coefficient of friction of the surface of the image-able layer was measured according to ASTM D1894-78. It is noted that $\mu_s$ and $\mu_k$ stand for the coefficients of static and dynamic friction, respectively.

TABLE 1-1

| Example | Ink compositions for the formation of dye-receiving layers: Reactive Resin (pbw) | | Reactive Release Agent (pbw) | | Reactive Release Agent (pbw) | | Reactive Additive (pbw) | | Curing Type |
|---|---|---|---|---|---|---|---|---|---|
| 1 | Polyester resin (OH number: 22) | 20 | Amino modified silicone oil | 1 | Epoxy modified silicone oil | 1 | TDI modified polyisocyanate | 1 | Heat-curing |
| 2 | Polyester resin (OH number: 12) | 20 | Amino modified silicone oil | 2 | — | | TDI modified polyisocyanate | 1 | Heat-curing |
| 3 | Polyester resin (OH number: 12) | 20 | Amino modified silicone oil | 2 | — | | TDI modified polyisocyanate | 1 | Heat-curing |
| 4 | Polyester resin (OH number: 9) | 20 | Amino modified silicone oil | 3 | — | | TDI modified polyisocyanate | 1 | Heat-curing |
| 5 | Polyester resin (OH number: 8) | 20 | Carboxy modified silicone oil | 2 | — | | TDI modified polyisocyanate | 1 | Heat-curing |
| 6 | Polyester resin (OH number: 22) | 20 | Isocyanate modified silicone oil | 3 | — | | Pentaerithritol | 1 | Heat- |
| 7 | Polyester resin (OH number: 12) | 20 | Amide stearate | 3 | — | | TDI modified polyisocyanate | 1 | Heat-curing |
| 8 | Polyester resin ($NH_2$ number: 18) | 20 | Epoxy modified silicone oil | 2 | — | | TDI modified polyisocyanate | 1 | Heat-curing |
| 9 | Vinyl chloride/-vinyl acetate copolymer (OH number: 20) | 20 | Amino modified silicone oil | 1 | Epoxy modified silicone oil | 1 | TDI modified polyisocyanate | 1 | Heat-curing |
| 10 | Acrylic polyol (OH number: 25) | 20 | Amino modified silicone oil | 2 | — | | TDI modified polyisacyanate | 1 | Heat-curing |

TABLE 1-2

| Example | Ink compositions for the formation of dye-receiving layers: Reactive Resin (pbw) | | Reactive Release Agent (pbw) | | Reactive Release Agent (pbw) | | Reactive Additive (pbw) | | Curing Type |
|---|---|---|---|---|---|---|---|---|---|
| 11 | Hydroxyethyl cellulose (OH number: 28) | 20 | Amino modified silicone oil | 2 | — | | TDI modified polyisocyanate | 1 | Heat-curing |
| 12 | Carboxy modified butyral (:10) | 20 | Amino modified silicone oil | 3 | — | | TDI modified polyisocyanate | 1 | Heat-curing |
| 13 | Polyvinyl butyral (OH number: 27) | 20 | Amino modified silicone oil | 3 | — | | TDI modified polyisocyanate | 1 | Heat-curing |
| 14 | Unsaturated polyester resin | 20 | Stearic acid modified acrylate | 3 | — | | Urethane acrylate | 2 | ED-UV curing type |
| 15 | Acrylic modified polyester resin | 20 | Stearic acid modified acrylate | 3 | — | | Diallyl phthalate | 2 | Heat-curing |
| 16 | Acrylic modified polyester resin | 20 | Acrylic modified acrylate | 3 | — | | Urethane acrylate | 2 | Heat-curing |
| 17 | Acrylic modified polyester resin | 20 | Stearic acid modified acrylate | 3 | — | | Urethane acrylate | 2 | Heat-curing |

TABLE 1-3

| Comparative Example | Ink compositions for the formation of dye-receiving layers: Reactive Resin (pbw) | | Reactive Release Agent (pbw) | | Reactive Release Agent (pbw) | | Reactive Additive (pbw) | Curing Type |
|---|---|---|---|---|---|---|---|---|
| 1 | Polyester resin (OH number: 22) | 20 | Amino modified silicone oil | 1 | Epoxy modified silicone oil | 1 | — | ED-UV curing type |
| 2 | Polyester resin (OH number: 12) | 20 | Alkyl modified silicone oil | 2 | — | | — | — |
| 3 | Vinyl chloride/-vinyl acetate copolymer (OH number: 20) | 20 | Alkyl modified silicone oil | 3 | — | | — | — |
| 4 | Acrylic polyol (OH number: 25) | 20 | modified silicone oil | 2 | — | | — | — |
| 5 | Unsaturated polyester resin | 20 | Amino modified silicone oil | 2 | — | | — | — |
| 6 | Acryl resin | 20 | Amino modified | 3 | — | | — | — |

TABLE 1-3-continued

| Comparative Example | Ink compositions for the formation of dye-receiving layers | | | | |
|---|---|---|---|---|---|
| | Reactive Resin (pbw) | Reactive Release Agent (pbw) | Reactive Release Agent (pbw) | Reactive Additive (pbw) | Curing Type |
| | | silicone oil | | | |

TABLE 2

| | Density of printing (O.D.) | Rate of thermal fading (%) | Coefficient of friction | |
|---|---|---|---|---|
| | | | $\mu_s$ | $\mu_k$ |
| Example 1 | 1.52 | 2.6 | 0.29 | 0.20 |
| Example 2 | 1.55 | 3.2 | 0.25 | 0.18 |
| Example 3 | 1.50 | 2.7 | 0.27 | 0.18 |
| Example 4 | 1.53 | 2.6 | 0.27 | 0.17 |
| Example 5 | 1.57 | 3.8 | 0.29 | 0.18 |
| Example 6 | 1.48 | 4.8 | 0.26 | 0.19 |
| Example 7 | 1.51 | 4.2 | 0.25 | 0.16 |
| Example 8 | 1.50 | 3.6 | 0.28 | 0.20 |
| Example 9 | 1.52 | 1.8 | 0.28 | 0.21 |
| Example 10 | 1.48 | 2.0 | 0.27 | 0.18 |
| Example 11 | 1.50 | 2.3 | 0.29 | 0.20 |
| Example 12 | 1.48 | −0.4 | 0.27 | 0.18 |
| Example 13 | 1.46 | 3.0 | 0.28 | 0.15 |
| Example 14 | 1.45 | 3.7 | 0.27 | 0.16 |
| Example 15 | 1.50 | 5.2 | 0.30 | 0.18 |
| Example 16 | 1.54 | 3.3 | 0.28 | 0.19 |
| Example 17 | 1.53 | 4.5 | 0.29 | 0.17 |
| Comparative Example 1 | 1.54 | 16.3 | 0.29 | 0.17 |
| Comparative Example 2 | 1.49 | 18.2 | 0.31 | 0.20 |
| Comparative Example 3 | 1.58 | 19.7 | 0.28 | 0.20 |
| Comparative Example 4 | 1.52 | 23.8 | 0.27 | 0.18 |
| Comparative Example 5 | 1.47 | 27.8 | 0.33 | 0.25 |
| Comparative Example 6 | 1.32 | 12.2 | 0.32 | 0.23 |

As will be appreciated from the above examples, the recording materials of the present invention include a dye-receiving layer obtained by crosslinking and curing the resin capable of receiving the dye transferred from the heat transfer sheet by heating and having a crosslinkable reaction group with the release agent having a crosslinkable reaction group and so excel in releasability and heat resistance.

If the dye-receiving layer is formed by crosslinking and curing the above resin and release agent together with the additive having a crosslinkable reaction group, then the recording materials of the present invention are improved in terms of not only releasability and heat resistance but also various properties such as elongation, heat resistance, flexibility and surface activity.

According to the present invention, high-sensitivity printing can be made at high concentrations because of the imageable layer being of a three-dimensional crosslinked structure. In addition, the storability of the image after heat transfer recording is much more improved.

EXAMPLES A1–A9 AND COMPARATIVE EXAMPLES A1–A12

In similar manners as set forth in Ex. 1, imageable sheets having dye-receiving layers composed of such ingredients as indicated in Table 3-1 and 2 were prepared. The results of various performance tests are shown in Table 4.

TABLE 3-1

| | Compositions of dye-receiving layers | | | | | | | | |
|---|---|---|---|---|---|---|---|---|---|
| | Resin (pbw) | | Release Agent (pbw) | | Release Agent (pbw) | | Curing (pbw) | | NCO/OH |
| Comparative Example A1 | Polyester resin OHV = 8 | (20) | Amino modified silicone oil | (1) | Epoxy modified silicone oil | (1) | TDI modified polyisocyanate NCO % = 15% | (1) | 1.0 |
| Example A1 | Polyester resin OHV = 8 | (20) | Amino modified silicone oii | (1) | Epoxy modified silicone oil | (1) | TDI modified polyisocyanate NCO % = 15% | (3) | 3.0 |
| Example A2 | Polyester resin OHV = 8 | (20) | Amino modified silicone oil | (1) | Epoxy modified silicone oil | (1) | TDI modified polyisocyanate NCO % = 15% | (4) | 5.0 |
| Example A3 | Polyester resin OHV = 8 | (20) | Amino modified silicone oil | (1) | Epoxy modified silicone oil | (1) | TDI modified polyisocyanate NCO % = 15% | (7) | 8.0 |
| Comparative Example A2 | Polyester resin OHV = 8 | (20) | Amino modified silicone oil | (1) | Epoxy modified silicone oil | (1) | TDI modified polyisocyanate NCO % = 15% | (12) | 15.0 |
| Comparative Example A3 | Polyester resin OHV = 8 | (20) | Amino modified silicone oil | (1) | Epoxy modified silicone oil | (1) | TDI modified polyisocyanate NCO % = 15% | (16) | 20.0 |

TABLE 3-2

| | Compositions of dye-receiving layers | | | | | | | | |
|---|---|---|---|---|---|---|---|---|---|
| | Resin (pbw) | | Release Agent (pbw) | | Release Agent (pbw) | | Curing (pbw) | | NCO/OH |
| Comparative Example A4 | Polyester resin OHV = 8 | (20) | Amino modified silicone oil | (1) | Epoxy modified silicone oil | (1) | TDI modified polyisocyanate NCO % = 15% | (32) | 40.0 |
| Comparative Example A5 | Polyester resin OHV = 20 | (20) | Amino modified silicone oil | (1) | Epoxy modified silicone oil | (1) | TDI modified polyisocyanate NCO % = 15% | (2) | 1.0 |
| Example A4 | Polyester resin OHV = 20 | (20) | Amino modified silicone oil | (1) | Epoxy modified silicone oil | (1) | TDI modified polyisocyanate NCO % = 15% | (8) | 4.0 |

TABLE 3-2-continued

| | Compositions of dye-receiving layers | | | | | | | | |
|---|---|---|---|---|---|---|---|---|---|
| | Resin (pbw) | | Release Agent (pbw) | | Release Agent (pbw) | | Curing (pbw) | | NCO/OH |
| Example A5 | Polyester resin OHV = 20 | (20) | Amino modified silicone oil | (1) | Epoxy modified silicone oil | (1) | TDI modified polyisocyanate NCO % = 15% | (12) | 6.0 |
| Comparative Example A6 | Polyester resin OHV = 20 | (20) | Amino modified silicone oil | (1) | Epoxy modified silicone oil | (1) | TDI modified polyisocyanate NCO % = 15% | (20) | 12.0 |

TABLE 3-3

| | Compositions of dye-receiving layers | | | | | | | | |
|---|---|---|---|---|---|---|---|---|---|
| | Resin (pbw) | | Release Agent (pbw) | | Release Agent (pbw) | | Curing (pbw) | | NCO/OH |
| Comparative Example A7 | Polyester resin OHV = 12 | (20) | Amino modified silicone oil | (1) | Epoxy modified silicone oil | (1) | HDI modified polyisocyanate NCO % = 15% | (1) | 1.0 |
| Example A6 | Polyester resin OHV = 12 | (20) | Amino modified silicone oil | (1) | Epoxy modified silicone oil | (1) | HDI modified polyisocyanate NCO % = 15% | (2) | 3.0 |
| Example A7 | Polyester resin OHV = 12 | (20) | Amino modified silicone oil | (1) | Epoxy modified silicone oil | (1) | HDI modified polyisocyanate NCO % = 15% | (4) | 5.0 |
| Comparative Example A8 | Polyester resin OHV = 12 | (20) | Amino modified silicone oil | (1) | Epoxy modified silicone oil | (1) | HDI modified polyisocyanate NCO % = 15% | (10) | 12.0 |
| Comparative Example A9 | Polyvinyl butyral OHV = 27 | (20) | Amino modified silicone oil | (1) | Epoxy modified silicone oil | (1) | HDI modified polyisocyanate NCO % = 15% | (2) | 1.0 |
| Example A8 | Polyvinyl butyral OHV = 27 | (20) | Amino modified silicone oil | (1) | Epoxy modified silicone oil | (1) | HDI modified polyisocyanate NCO % = 15% | (7) | 4.0 |

TABLE 3-4

| | Compositions of dye-receiving layers | | | | | | | | |
|---|---|---|---|---|---|---|---|---|---|
| | Resin (pbw) | | Release Agent (pbw) | | Release Agent (pbw) | | Curing (pbw) | | NCO/OH |
| Comparative Example A10 | Polyvinyl butyral OHV = 27 | (20) | Amino modified silicone oil | (1) | Epoxy modified silicone oil | (1) | HDI modified polyisocyanate NCO % = 22% | (22) | 12.0 |
| Comparative Example A11 | Vinyl chloride/-vinyl acetate copolymer OHV = 20 | (20) | Amino modified silicone oil | (1) | Epoxy modified silicone oil | (1) | HDI modified polyisocyanate NCO % = 22% | (1) | 1.0 |
| Example A9 | Vinyl chloride/-vinyl acetate copolymer OHV = 20 | (20) | Amino modified silicione oil | (1) | Epoxy modified silicone oil | (1) | HDI modified polyisocyanate NCO % = 22% | (5) | 4.0 |
| Comparative Example A12 | Vinyl chloride/-vinyl acetate copolymer OHV = 20 | (20) | Amino modified silicone oil | (1) | Epoxy modified silicone oil | (1) | HDI modified polyisocyanate NCO % = 22% | (16) | 12.0 |

(Note)
OHV; Hydroxyl number
NCO %; Isocyanate group content of solid polyisocyanate matter

TABLE 4

| | Gloss of solid-printed face (%) | Printing sensitivity (%) | Rate of thermal fading (%) | Rate of optical fading (%) |
|---|---|---|---|---|
| Comparative Example A1 | 61.6 | 1.02 | 8.3 | 7.6 |
| Example A1 | 90.1 | 1.00 | 9.4 | 8.7 |
| Example A2 | 91.4 | 1.01 | 10.1 | 9.4 |
| Example A3 | 92.5 | 0.95 | 10.6 | 9.9 |
| Comparative Example A2 | 91.9 | 0.94 | 15.7 | 15.0 |
| Comparative Example A3 | 91.7 | 0.76 | 20.3 | 19.5 |
| Comparative Example A4 | 92.0 | 0.66 | 36.4 | 35.6 |
| Comparative Example A5 | 64.5 | 1.01 | 7.5 | 6.8 |
| Example A4 | 90.7 | 1.02 | 9.7 | 9.0 |
| Example A5 | 91.4 | 1.00 | 10.2 | 9.5 |
| Comparative | 91.4 | 0.95 | 16.0 | 15.3 |

TABLE 4-continued

| | Gloss of solid-printed face (%) | Printing sensitivity (%) | Rate of thermal fading (%) | Rate of optical fading (%) |
|---|---|---|---|---|
| Example A6 | | | | |
| Comparative Example A7 | 62.2 | 1.01 | 5.5 | 4.8 |
| Example A6 | 92.3 | 1.02 | 6.3 | 5.5 |
| Example A7 | 92.0 | 1.00 | 7.7 | 7.0 |
| Comparative Example A8 | 92.4 | 0.90 | 12.6 | 11.9 |
| Comparative Example A9 | 64.3 | 1.03 | 7.4 | 6.6 |
| Example A8 | 91.0 | 1.00 | 9.6 | 8.9 |
| Comparative Example A10 | 91.5 | 0.88 | 13.7 | 13.0 |
| Comparative Example A11 | 72.6 | 1.06 | 2.6 | 1.9 |
| Example A9 | 93.6 | 1.02 | 5.7 | 5.0 |
| Comparative | 92.9 | 0.86 | 13.4 | 12.7 |

TABLE 4-continued

| | Gloss of solid-printed face (%) | Printing sensitivity (%) | Rate of thermal fading (%) | Rate of optical fading (%) |
|---|---|---|---|---|
| Example A12 | | | | |

Note: Estimation of the above results (1) Gloss (%) of Solid-Printed Face

The face (typeface) of a 'solid pattern' printed on the surface of the receiving layer was measured in terms of glossiness with a glossmeter.

(2) Printing Sensitivity

The concentration of reflection of the typeface was determined with a Macbeth reflection densitometer and estimated on the basis of the value (1.0) of Ex. 1.

(b 3) Rate of thermal fading

After the print was allowed to stand in an atmosphere of 60° C. (dry) for 200 hours, its rate of thermal fading was found by the following equation:

$$\frac{\text{(con. of reflection-before)} - \text{(con. of reflection-after)}}{\text{(concentration of reflection-before)}} \times 100\ (\%)$$

(4) rate of optical fading

After the print was exposed to light with an Xe Fede-O-Meter according to JIs-4 irradiation, its rate of optical fading was found by the following equation:

$$\frac{\text{(con. of reflection before test)} - \text{(con. of reflection after test)}}{\text{(concentration of reflection before test)}} \times 100\ (\%)$$

EXAMPLES B1–B6 AND COMPARATIVE EXAMPLES B1–B6

In order to examine an effect of the curing catalysts added, imageable sheets including dye-receiving layers composed of such ingredients as indicated below were prepared to measure their rates of thermal and optical fading. The results are indicated in Table 5.

| | parts by weight |
|---|---|
| Polyester resin | 20.0 |
| HDI modified polyisocyanate | 3.0 |
| Epoxy modified silicone oil | 1.0 |
| Amino modified silicone oil | 1.0 |
| MEK | 40.0 |
| Toluene | 40.0 |
| Catalyst | 0.1 |

TABLE 5

| | Catalysts | Rate of thermal fading (%) | Rate of optical fading (%) | Curing time (120° C.) |
|---|---|---|---|---|
| Example B1 | Dibutyltin dilaurate | 9.5 | 11.4 | |
| Example B2 | Dibutyltin dimercaptide | 8.8 | 10.3 | |
| Example B3 | Dibutyltin diacetate | 9.2 | 11.1 | |
| Example B4 | Dibutyltin dilaurate | 9.6 | 10.4 | 1 min. |
| Example B5 | Dibutyltin maleate | 8.9 | 10.7 | |
| Example B6 | Dibutyltin glycolate | 9.1 | 11.6 | |
| Example B7 | Stannous octoate | 8.8 | 10.9 | |
| Comparative Example B1 | No addition | 9.3 | 10.4 | 10 min. |
| Comparative Example B2 | Triethylenediamine | 31.2 | 20.0 | |
| Comparative Example B3 | Tetramethylbutadiene | 32.4 | 21.2 | |
| Comparative Example B4 | Triethylamine | 30.7 | 19.9 | 1 min. |
| Comparative Example B5 | Tetramethyl guanidine | 33.6 | 19.5 | |
| Comparative Example B6 | Tetramethyl hexadiamine | 28.7 | 25.6 | |

EXAMPLES C1–C8 AND COMPARATIVE EXAMPLES C1–C6

A magnetic coating material was coated and dried on a polyethylene terephthalate film (of 250 μm in thickness) in conventional manners to form a magnetic recording layer of 5 μm in thickness.

Then, an ink for each colored concealing layer, composed of such ingredients as given below, was coated, dried and cured to a thickness of 5 μm on dry basis in gravure offset printing fashion to form a colored concealing layer. (In Examples 3, 4 and 8, an addition ink for the back protecting layers, composed of such ingredients as given below, was coated, dried and cured to a thickness of 2 μm on dry basis in gravure offset printing fashion to form a back protecting layer.)

Finally, the ink used in Ex. 1 for the formation of the dye-receiving layer was coated and dried to a thickness of 5 μm on dry basis on the opposite sides of the substrates to prepare magnetic cards according to the examples and comparative examples.

Ink Composition for the Formation of Receiving Layer (common)

| | parts by weight |
|---|---|
| Polyester resin | 20 |
| Amino modified silicone oil | 1 |
| Epoxy modified silicone oil | 1 |
| TDI modified polyisocyanate | 1 |
| Methyl ethyl ketone | 40 |
| Toluene | 40 |

EXAMPLES C1 (Colored Concealing Layer alone)

Ink Composition for Colored Concealing Layer

| | parts by weight |
|---|---|
| Vinyl chloride/vinyl acetate copolymer resin | 20 |
| Pigment | 10 |
| Isocyanate curing agent | 3 |
| Methyl ethyl ketone | 30 |
| Toluene | 40 |
| Curing by heat | |

EXAMPLE C2 (Colored Concealing Layer alone)

Ink Composition for Colored Concealing Layer

| | parts by weight |
|---|---|
| Acrylic polyol | 20 |
| Acrylic monomer | 5 |
| Benzophenone | 0.1 |
| Pigment | 10 |
| Toluene | 70 |
| Curing by ultraviolet rays | |

EXAMPLE C3 (Colored Concealing Layer+Back Protecting Layer)

Ink Composition for Colored Concealing Layer (Non-Crosslinked)

| | parts by weight |
|---|---|
| Vinyl chloride/vinyl acetate copolymer resin | 30 |
| Pigment | 10 |
| Toluene | 60 |

Ink Composition for Back Protecting Layer

| | |
|---|---|
| Polyurethane resin | 30 |
| Isocyanate curing agent | 2 |
| Toluene | 70 |
| Curing by heat | |

EXAMPLE C4 (Colored Concealing Layer+Back Protecting Layer)

Ink Composition for Colored Concealing Layer (Non-crosslinked)

| | parts by weight |
|---|---|
| Ethyl polyacrylate resin | 40 |
| Pigment | 5 |
| Toluene | 60 |

Ink Composition for Back Protecting Layer

| | |
|---|---|
| Acrylic polyol | 20 |
| Urethane acrylate | 10 |
| Toluene | 70 |
| Curing by electron radiation | |

EXAMPLE C5 (Colored Concealing Layer alone)

Ink Composition for Colored Concealing Layer

| | parts by weight |
|---|---|
| Polyester resin | 20 |
| Pigment | 10 |
| Isocyanate curing agent | 6 |
| Toluene | 40 |
| Isopropyl alcohol | 30 |
| Curing by heating | |

EXAMPLE C6 (Colored Concealing Layer alone)

Ink Composition for Colored Concealing Layer

| | parts by weight |
|---|---|
| Unsaturated polyester resin | 20 |
| Diallyl phthalate | 20 |
| Pigment | 5 |
| Benzophenone | 0.1 |
| Methyl ethyl ketone | 10 |
| Toluene | 30 |
| Curing by ultraviolet rays | |

EXAMPLE C8 (Colored Concealing Layer+Back Protecting Layer)

Ink Composition for Colored Concealing Layer

| | parts by weight |
|---|---|
| Cellulose acetate | 30 |
| Isocyanate curing agent | 3 |
| Pigment | 5 |
| Toluene | 40 |
| Isopropyl alcohol | 30 |
| Curing by heating | |

Ink Composition for Back Protecting Layer

| | |
|---|---|
| Rosin modified maleate resin | 30 |
| Isocyanate curing agent | 5 |
| Toluene | 70 |
| Curing by heating | |

Comparative Example C1

Ink Composition for Colored Concealing Layer

| | parts by weight |
|---|---|
| Vinyl chloride/vinyl acetate copolymer resin | 30 |
| Pigment | 10 |
| Methyl ethyl ketone | 30 |
| Toluene | 30 |

Comparative Example 2

Ink Composition for Colored Concealing Layer

| | parts by weight |
|---|---|
| Acrylic polyol | 20 |
| Pigment | 10 |
| Toluene | 60 |

Comparative Example C3

Ink Composition for Colored Concealing Layer

| | parts by weight |
|---|---|
| Ethyl polyacrylate resin | 40 |
| Pigment | 5 |
| Toluene | 50 |

Comparative Example C4

Ink Composition for Colored Concealing Layer

| | parts by weight |
|---|---|
| Polyester resin | 20 |
| Pigment | 10 |
| Methyl ethyl ketone | 20 |
| Toluene | 20 |

Comparative Example C5

Ink Composition for Colored Concealing Layer

| | parts by weight |
|---|---|
| Polyurethane resin | 30 |
| Pigment | 5 |
| Toluene | 60 |

Comparative Example C6

Ink Composition for Colored Concealing Layer

| | parts by weight |
|---|---|
| Polyamide resin | 30 |
| Pigment | 10 |
| Toluene | 30 |

-continued

| | parts by weight |
|---|---|
| Isopropyl alcohol | 30 |

Examples of Use

With a sublimable transfer type of heat transfer printer, solid printing was made on the dye-receiving layers of the magnetic cards of the above examples and comparative examples at a preset application voltage of level 3. After printing, the occurrence of irregularities and curls of the cards was observed. The results are set out in Table 6.

TABLE 6

| | Occurrence of irregularities | | | Curling after printing | | |
|---|---|---|---|---|---|---|
| Example | 6.0 V | 9.0 V | 12.0 V | 6.0 V | 9.0 V | 12.0 V |
| Example C1 | not found | not found | slight | not found | not found | not found |
| Example C2 | not found | not found | not found | not found | not found | not found |
| Example C3 | not found | not found | not found | not found | not found | not found |
| Example C4 | not found | not found | not found | not found | not found | not found |
| Example C5 | not found | not found | slight | not found | not found | not found |
| Example C6 | not found | not found | not found | not found | not found | not found |
| Example C7 | not found | not found | not found | not found | not found | not found |
| Example C8 | not found | not found | not found | not found | not found | not found |
| Comparative Example C1 | not found | slight | excessive | not found | noticeable | excessive |
| Comparative Example C2 | not found | slight | noticeable | not found | slight | excessive |
| Comparative Example C3 | not found | slight | noticeable | not found | slight | noticeable |
| Comparative Example C4 | not found | noticeable | excessive | not found | noticeable | excessive |
| Comparative Example C5 | not found | noticeable | excessive | slight | noticeable | excessive |
| Comparative Example C6 | not found | slight | excessive | not found | noticeable | excessive |

As will be understood from Table 6, the magnetic cards of the present invention can be printed at high density with neither irregularities nor curling, so that they can be easily fed into equipment with accurate reading-out or writing-in.

Industrial Applicability

The thermosensitive recording materials of the present invention have wide application in the form of recording media for heat transfer recording systems designed to make printing or form images by thermal printing means such as thermal heads. The thermosensitive recording materials of the present invention can also be used as card-form media, e.g., magnetic cards having thermosensitive recording means.

What is claimed is:

1. A thermosensitive recording material used in combination with a heat transfer sheet carried thereon with a thermally transferable dye, said thermosensitive recording material comprising:

a substrate and a dye-receiving layer provided on the surface of said substrate, said dye-receiving layer being formed by curing (1) a polyester resin having crosslinkable reaction groups, (2) a silicone oil having a reaction group, (3) a polyisocyanate, and (4) a catalyst comprising an organometallic compound based on dibutyltin or dioctyltin.

2. The thermosensitive recording material of claim 1 wherein said catalyst is selected from the group consisting of dibutyltin dilaurate, dibutyltin oxide, dibutyltin dichloride, dibutyltin di-2-ethylhexyl thioglycolate, dibutyltin di(monobutyl) maleate, dibutyltin di(-monononyl) maleate, dibutyltin diacetate, dibutyltin mercaptide, dibutyltin β-mercaptopropionate, dibutyltin thiocarboxylate, dibutyltin di-2-ethylhexoate, dioctyltin dilaurate, dioctyltin thioglycolate, dioctyltin β-mercaptopropionate, dioctyltin-1,4-butanediol-bis(mercaptoacetate), dioctyltin ethylene glycol dithioglycolate, dioctyltin thiocarboxylate, dioctyltin maleate, dioctyltin maleate polymer, dioctyltin-(1,2-propylene glycol maleate), dioctyltin-di(monobutyl) maleate, dioctyltin-bis-(2-ethylhexyl maleate), dioctyltin-bis(lauryl thioglycolate), dioctyltin oxide, dioctyltin dichloride, mono-octyltin dichloride, and trioctyltin dichloride.

3. A thermosensitive recording material used in combination with a heat transfer sheet carried thereon with a thermally transferable dye, said thermosensitive recording material comprising:

a substrate and a dye-receiving layer provided on the surface of said substrate, said dye-receiving layer being formed by curing (1) a polyester resin having crosslinkable reaction groups, (2) a silicone oil having a reaction group, (3) a polyisocyanate, and (4) an organometallic compound catalyst selected from the group consisting of stannous octoate, lead octoate, cobalt naphthenate, stannous chloride, stannic chloride, tetra-n-butyltin, tetraphenyltin, trimethyltin hydroxide, and dimethyl-2-tin chloride.

* * * * *